US009305443B2

(12) United States Patent
Pritchett et al.

(10) Patent No.: US 9,305,443 B2
(45) Date of Patent: Apr. 5, 2016

(54) LED SECURITY SENSOR

(71) Applicant: Royne Industries, LLC, La Jolla, CA (US)

(72) Inventors: Christopher Pritchett, San Diego, CA (US); Kevin Ruckley, San Diego, CA (US)

(73) Assignee: Royne Industries, LLC, La Jolla, CA (US)

( * ) Notice: Subject to any disclaimer, the term of this patent is extended or adjusted under 35 U.S.C. 154(b) by 0 days.

(21) Appl. No.: 14/250,376

(22) Filed: Apr. 10, 2014

(65) Prior Publication Data

US 2014/0306824 A1 Oct. 16, 2014

Related U.S. Application Data

(60) Provisional application No. 61/810,577, filed on Apr. 10, 2013.

(51) Int. Cl.
*G08B 13/08* (2006.01)

(52) U.S. Cl.
CPC ..... *G08B 13/08* (2013.01)

(58) Field of Classification Search
CPC ..... G07B 15/063; G07C 2009/00793; G07C 9/00309; G07C 9/00103; G07C 1/10; G07C 9/00015; G07C 9/00039; H04W 12/08; G08C 17/02; G08C 2201/31; G08C 2201/91; G08C 2201/50; G08C 2201/62
USPC ..... 340/545.2, 545.1, 540, 547, 686.1, 340/310.06, 310.08, 521, 538–539, 574
See application file for complete search history.

(56) References Cited

U.S. PATENT DOCUMENTS 4,686,912 A * 8/1987 Fogleman et al. ..... 109/59 T
5,319,362 A * 6/1994 Hyatt, Jr. ..... 340/5.33
6,130,611 A * 10/2000 Pellaton et al. ..... 340/542
6,310,548 B1 * 10/2001 Stephens, Jr. ..... G08B 13/08 340/540
6,430,064 B1 * 8/2002 Tsuchimoto ..... H02J 5/005 363/22

* cited by examiner

*Primary Examiner* — Daniel Previl
(74) *Attorney, Agent, or Firm* — Rylander & Associates, PC; Philip R. M. Hunt

(57) ABSTRACT

A door sensor system comprising door sensor circuit and a sensor support circuit. The door sensor circuit has the anode of a first LED and the anode of a second LED coupled to a supply voltage terminal. The door sensor circuit has one or more reed switches, each with a first terminal coupled to the first LED cathode and a second terminal coupled to a sensor output terminal. The door sensor circuit has a Zener diode with a cathode coupled to the second LED cathode and an anode coupled to the sensor output terminal. The sensor support circuit is configured to generate, based on the voltage at the sensor output terminal, a first signal if the door is open, a second signal if the door is closed, and a third signal if tampering with the door sensor system is detected.

6 Claims, 3 Drawing Sheets

LED SECURITY SENSOR

CROSS-REFERENCE TO RELATED APPLICATION

This application claims priority to U.S. Provisional Patent Application Ser. No. 61/810,577, "LED security sensor" filed 10 Apr. 2013.

BACKGROUND

1. Field of the Invention

The present invention relates to security systems.

2. State of the Prior Art

Security systems and/or security alarm systems often use magnetic switches attached to doors, windows, and other structures to detect the unauthorized opening and/or manipulation of the door, window, or other structures. However, many previous magnetic switch designs have been prone to tampering, have exhibited unacceptable reliability.

Magnetic switches use the detection of a magnetic field and/or the absence of a magnetic field to indicate that a door, window, or other enclosure access has been opened. In its simplest form, a magnetic switch uses permanent magnet mounted to an enclosure access, e.g. a door to a room, and a magnetic sensor, such as a reed switch, to detect the presence or absence of the permanent magnet. If the magnet is detected, then the door is in the expected position. If no magnet is detected, then the door is not in the expected position. This go/no-go signal can be used as an input to an alarm system, automatic monitoring systems, and/or safety interlocks.

BRIEF DESCRIPTION OF THE DRAWINGS

The present invention will be described by way of exemplary embodiments, but not limitations, illustrated in the accompanying drawings in which like references denote similar elements, and in which.

The accompanying drawings, which are incorporated into and constitute a part of this specification, illustrate one or more embodiments of the invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference.

Figure 1:
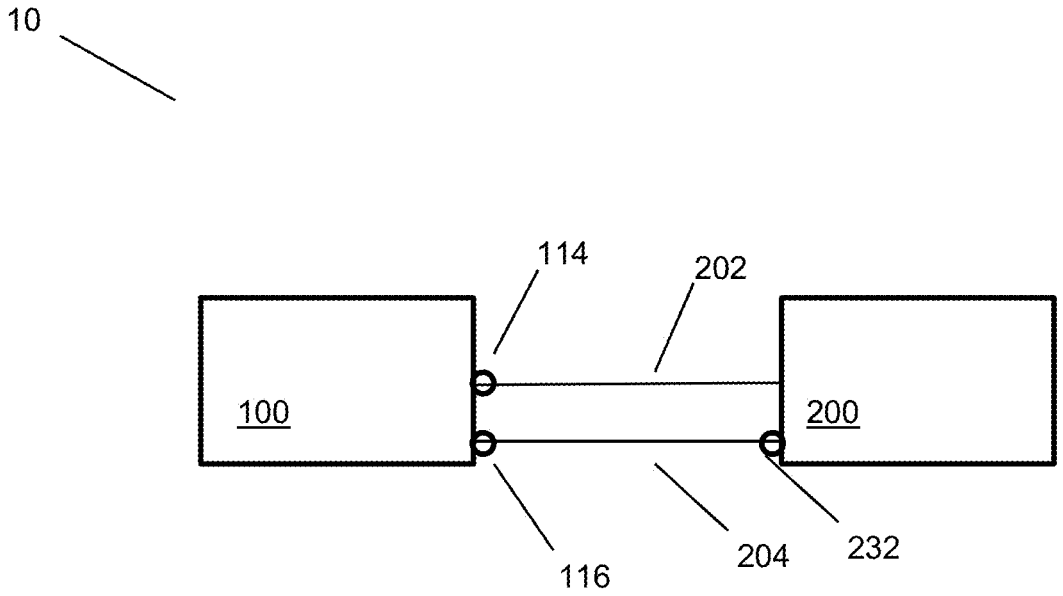
FIG. 1 shows an exemplary embodiment of a door sensor system in accordance with the invention.

FIG. 1 shows an exemplary embodiment of a door sensor system 10 in accordance with the invention. The door sensor system 10 has a door sensor circuit 100 connected to a sensor support circuit 200 with a voltage supply wire 202 and a sensor output wire 204.

Figure 2:
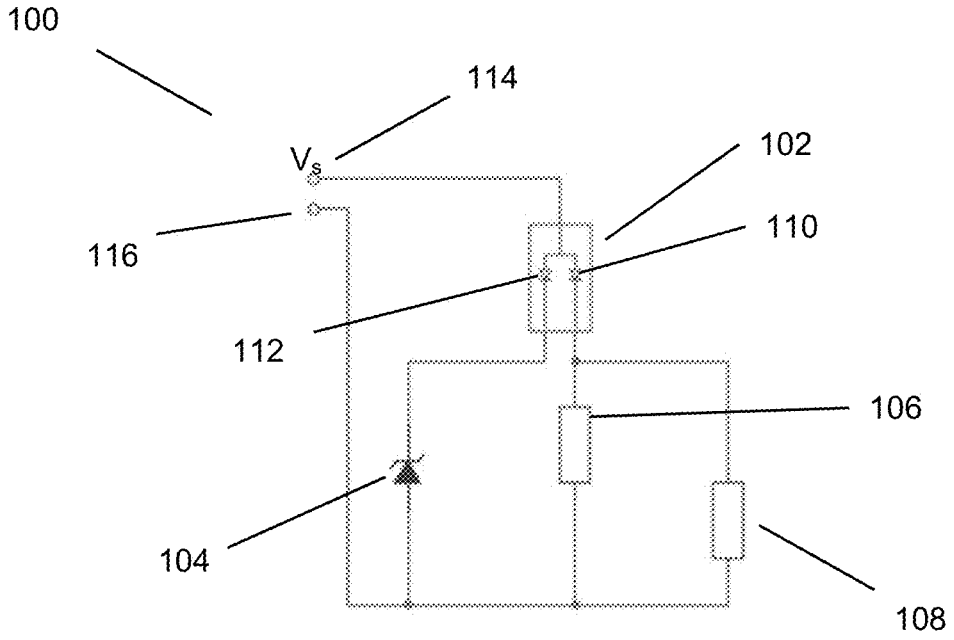
FIG. 2 shows the door sensor circuit that is part of the door sensor system.

FIG. 2 shows the door sensor circuit 100. The door sensor circuit 100 is typically enclosed in some type of housing, preferably with anti-tamper features. The housing with the enclosed door sensor circuit 100 is configured to be mounted to a door frame for the purpose of monitoring whether the door is open or shut.

The door sensor 100 has a supply voltage terminal 114 and a sensor output terminal 116 configured to electrically connect with a sensor support circuit 200, typically with a pair of wires. The supply voltage terminal 114 is configured to connect with a supply voltage $V_s$ in the sensor support circuit 200. In the exemplary embodiment, the supply voltage is +9 volts, but in other embodiments may be some other positive dc voltage. The sensor output terminal 116 is configured to carry a voltage signal back to the sensor support circuit 200 that indicates whether the door is open or closed.

The door sensor circuit 100 has a LED module 102, a Zener diode 104, and one or more reed switches. The exemplary embodiment has two reed switches—a first reed switch 106 and a second reed switch 108. The LED module 102 has at least two LEDs of different colors. In the exemplary embodiment, the LED module 102 has a first LED 110 configured to emitted light of a first color and a second LED 112 configured to emit light of a second color. In other embodiments the LED module 102 may have more than two LED, each of a different color. In the exemplary embodiment, the first color is blue and the second color is red, but in other embodiments, the LEDs may be of other colors. The anodes of the first LED 110 and second LED 112 are tied together and to connected the supply voltage terminal 114.

The cathode of the first LED 110 is connected to one terminal of the first reed switch 106 and one terminal of the second reed switch 108. If the door sensor circuit 100 has more than one reed switch, then the reed switches 106, 108 are connected in parallel. The other terminals of the reed switches 106, 108 are connected to the sensor output terminal 116. The cathode of the second LED 112 is connected to the cathode of the Zener diode 104.

Figure 3:
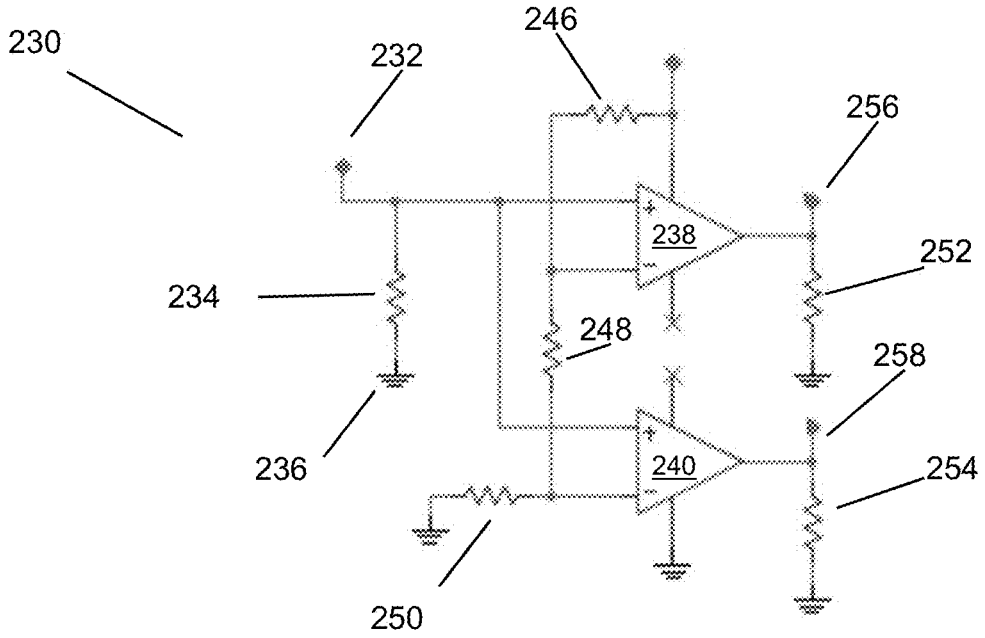
FIG. 3 shows a comparator circuit that is part of the sensor support circuit.

FIG. 3 shows a comparator circuit 230 that is part of the sensor support circuit 200. The comparator circuit 230 has a comparator input 232 that is configured to connect with the sensor output terminal 116 via the sensor output wire 204. A first resistor 234 is connected between the comparator input 232 and ground 236. The first resistor 234 limits current drawn from the sensor output terminal 116. The comparator circuit 230 has a first op amp 238 and a second op amp 240.

The comparator input 232 is connected to the positive inputs of the first op amp 238 and second op amp 240. A third resistor 246, a fourth resistor 248 and a fifth resistor 250 provide appropriate biasing for the op amps so they trigger at the desired input voltages. A sixth resistor 252 and seventh resistor 254 provide current limiting for a first op amp output 256 and second op amp output 258, respectively.

OPERATION

The first LED 110 has a first LED on-voltage $V_{O1}$ and the second LED 112 has a second LED on-voltage Vol. When the voltage across an LED is at or above its on-voltage, the LED illuminates, but below its on-voltage, the LED does not illuminate. In addition, the Zener diode 104 has a breakdown voltage $V_B$ above which the Zener diode 104 will pass current, but below which, it will block current. The values of the first LED on-voltage $V_{O1}$, second LED on-voltage $V_{O2}$, the supply voltage $V_S$, and the Zener diode breakdown voltage $V_B$ are selected such that the combination of the breakdown voltage $V_B$ with the second LED on-voltage $V_{O2}$ is less than the supply voltage $V_S$, but greater than the first LED on-voltage Vol. Thus when either first reed switch 106 or second reed switch 108 is closed, the first LED 110 illuminates but the second LED 112 is unilluminated. When both the first reed switch 106 and second reed switch 108 are open, the second LED 112 illuminates but the first LED 110 is unilluminated. The switch open condition will produce a greater voltage drop from the supply voltage terminal 114 to the sensor output terminal 116 than if one of the switches 106, 108 is closed. Thus the voltage at the sensor output terminal 116 and comparator input 232 is lower for the open switch condition than it is for the closed switch position.

If the voltage supply wire 202 and sensor output wire 204 connecting the door sensor circuit 100 to the sensor support circuit 200 are shorted together in an attempt to tamper and bypass the sensor, neither the first LED 110 nor second LED 112 will illuminate. Also, the voltage at the comparator input 232 will be the undiminished supply voltage $V_s$, which will allow the sensor support circuit 200 to distinguish between the switch open/switch closed conditions and a tempering condition.

For a "door open" event both the first op amp 238 comparator and second op amp 240 comparator give a "low" signal value. For a "door closed" event one op amp comparator gives a "low" signal value while the other gives a "high" signal value. If the wires 202, 204 between the door sensor circuit 100 and sensor support circuit 200 are tampered and shorted together both comparators return a "high" signal value.

Figure 4:
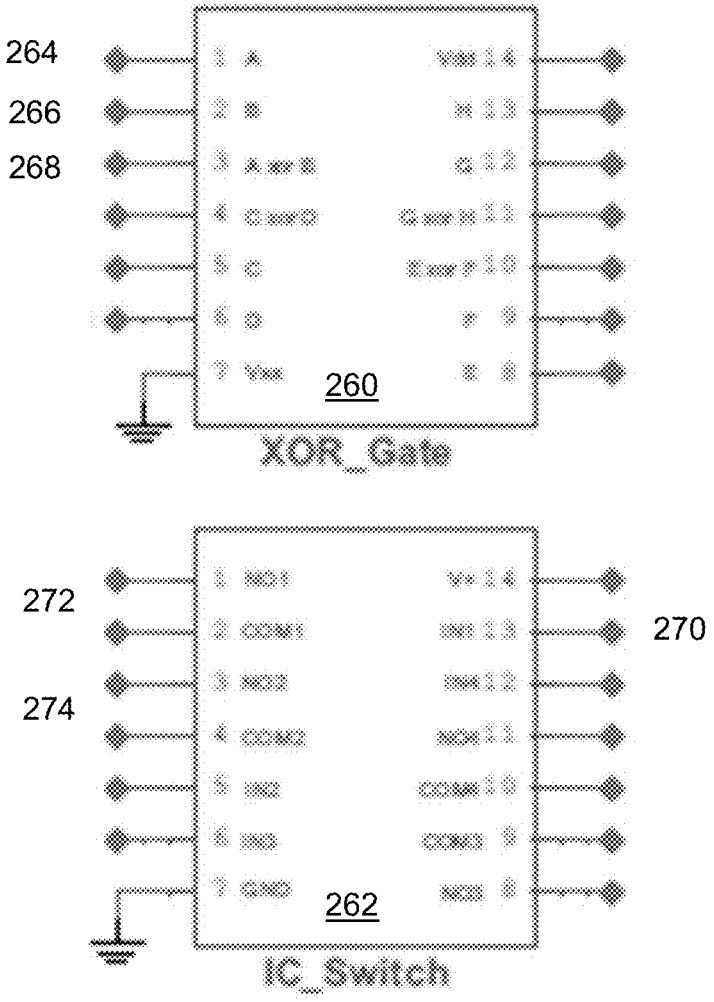
FIG. 4 shows an XOR Gate and an IC Switch, both part of the sensor support circuit.

FIG. 4 shows an XOR Gate 260 and an IC Switch 262, both part of the sensor support circuit 200. The first op amp output 256 is connected to a first XOR Gate input 264 and the second op amp output 258 is connected to a second XOR Gate input 266. An XOR gate output 268 will only output a high signal value for a closed door event. The XOR Gate output 268 is connected to an IC Switch input 270. The IC Switch input 270 has an IC Switch first output 272 and an IC Switch second output 274. The IC Switch first output 272 and IC Switch second output 274 close when there is a door closed event and open during an open door or tampered event. These two outputs are wired out to the security controller zone inputs to accurately communicate to the controller the status of the door sensor circuit.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A door sensor system comprising:

door sensor circuit with a supply voltage terminal, a sensor output terminal, a Zener diode, a first LED (light-emitting diode), a second LED (light-emitting diode), and a first reed switch;

wherein the first LED has a first LED anode and a first LED cathode, the second LED has a second LED anode and a second LED cathode, the Zener diode has a Zener diode anode and a Zener diode cathode, wherein the first LED anode and the second LED anode are coupled to the supply voltage terminal;

wherein the first reed switch has a first reed switch first terminal and a first reed switch second terminal;

wherein the second LED cathode is coupled to the Zener diode cathode and the Zener diode anode is coupled to the sensor output terminal;

wherein the first LED cathode is coupled to the first reed switch first terminal and the first reed switch second terminal is coupled to the sensor output terminal;

further comprising a sensor support circuit with a comparator circuit, wherein the sensor support circuit is configured for providing a supply voltage $V_s$ to the supply voltage terminal of the door sensor circuit;

wherein the first LED has a first LED on-voltage $V_{O1}$ and the second LED has a second LED on-voltage $V_{O2}$;

wherein the Zener diode has a breakdown voltage $V_B$;

wherein the values for first LED on-voltage $V_{O1}$, the second LED on-voltage $V_{O2}$, breakdown voltage $V_B$ and the supply voltage $V_s$ are such that the combination of the second LED on-voltage $V_{O2}$ and the breakdown voltage $V_B$ is less than the supply voltage $V_s$ and greater than the first LED on-voltage $V_{O1}$;

wherein the comparator circuit has a comparator input that is configured for coupling with the sensor output terminal;

wherein the comparator circuit is configured to output a first signal if a voltage at the comparator input is not greater than a first comparator voltage level;

wherein the comparator circuit is configured to output a second signal if a voltage at the comparator input is greater than the first comparator voltage level and not greater than a second comparator voltage level; and wherein the comparator circuit is configured to output a third signal if a voltage at the comparator input is greater than the second comparator voltage level.

2. The door sensor system of claim 1, wherein the first comparator voltage level is based on the first LED on-voltage $V_{O1}$; and wherein the second comparator voltage level is based on the combination of the second LED on-voltage $V_{O2}$ and the breakdown voltage $V_B$.

3. The door sensor system of claim 1, wherein the first comparator voltage level is equal to the supply voltage $V_s$ minus the first LED on-voltage $V_{O1}$; and wherein the second comparator voltage level is equal to the supply voltage Vs, minus the combination of the second LED on-voltage $V_{O2}$ and the breakdown voltage $V_B$.

4. The door sensor system of claim 1, wherein the first signal indicates a door is open;

wherein the second signal indicates the door is closed; and wherein the third signal indicates tampering with the door sensor system.

5. The door sensor system of claim 1, wherein the first LED is configured for emitting a light of a first color and the second LED is configured for emitting light of a second color.

6. The door sensor system of claim 1, further comprising a second reed switch with a second reed switch first terminal and a second reed switch second terminal; and wherein the first LED cathode is further coupled to the second reed switch first terminal and the second reed switch second terminal is coupled to the sensor output terminal.

* * * * *